US005397000A

United States Patent [19]

Holte et al.

[11] Patent Number: 5,397,000

[45] Date of Patent: Mar. 14, 1995

[54] SYSTEM FOR CONFINING ARTICLES IN A CONTAINER

[75] Inventors: Eric J. Holte, Gillette, Wyo.; Sean M. Holte, LaMesa, Calif.; Timothy R. Fitzer, Buffalo, Wyo.

[73] Assignee: Brainpower, Inc., Gillette, Wyo.

[21] Appl. No.: 278,570

[22] Filed: Jul. 21, 1994

Related U.S. Application Data

[63] Continuation of Ser. No. 870,560, Apr. 17, 1992, abandoned.

[51] Int. Cl.[6] ..... A45C 11/20; A47G 23/04

[52] U.S. Cl. ..... 206/545; 206/522; 206/594

[58] Field of Search ..... 206/591, 522, 594, 541, 206/550, 545; 220/420, 421, DIG. 10, 723; 417/545, 503, 514

[56] References Cited

U.S. PATENT DOCUMENTS

| | | | |
|---|---|---|---|
| 1,137,324 | 4/1915 | Jackson, Jr. . | |
| 2,555,126 | 5/1951 | Greve . | |
| 3,000,418 | 9/1961 | Bitting . | |
| 3,514,157 | 5/1970 | Geiser . | |
| 3,889,743 | 6/1975 | Presnick | 206/522 X |
| 4,286,440 | 9/1981 | Taylor . | |
| 4,432,401 | 2/1984 | Katz . | |
| 4,530,816 | 7/1985 | Douglas-Hamilton . | |
| 4,573,202 | 2/1986 | Lee . | |
| 4,673,007 | 6/1987 | Huang | 417/545 X |
| 4,762,231 | 8/1988 | Kiselewski | 206/522 |
| 4,767,004 | 8/1988 | Ishihara et al. . | |
| 4,801,213 | 1/1989 | Frey et al. | 206/522 X |
| 4,809,352 | 2/1989 | Walker | 206/522 X |
| 4,905,835 | 3/1990 | Pivert et al. . | |

*Primary Examiner*—Jacob K. Ackun, Jr.

*Attorney, Agent, or Firm*—Holland & Hart; Gary M. Polumbus

[57] ABSTRACT

A system for confining articles in a container includes a flexible air impermeable membrane that is adapted to overlie articles in the container and can be pneumatically and forcefully draped over the articles in the container to hold them in place. In the preferred embodiments of the invention, the membrane is in the form of an enclosed bladder which can either be inflated against the articles in the container or drawn against the articles by a vacuum drawn around the bladder. Pour spouts and pressure dispensing spouts are also disclosed for use in certain embodiment of the invention whereby liquids can be confined in the bladder and dispensed at either ambient pressures or elevated pressures. The bladder further defines means by which a coolant can be placed in the container and retained in a segregated relationship relative to the other articles in the container.

14 Claims, 8 Drawing Sheets

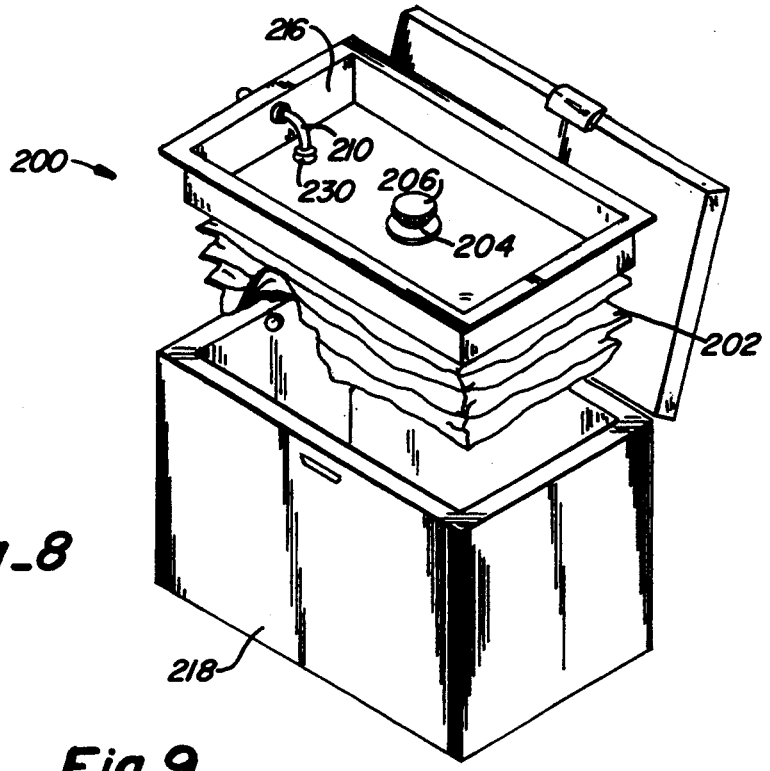
Fig_8
Fig_9
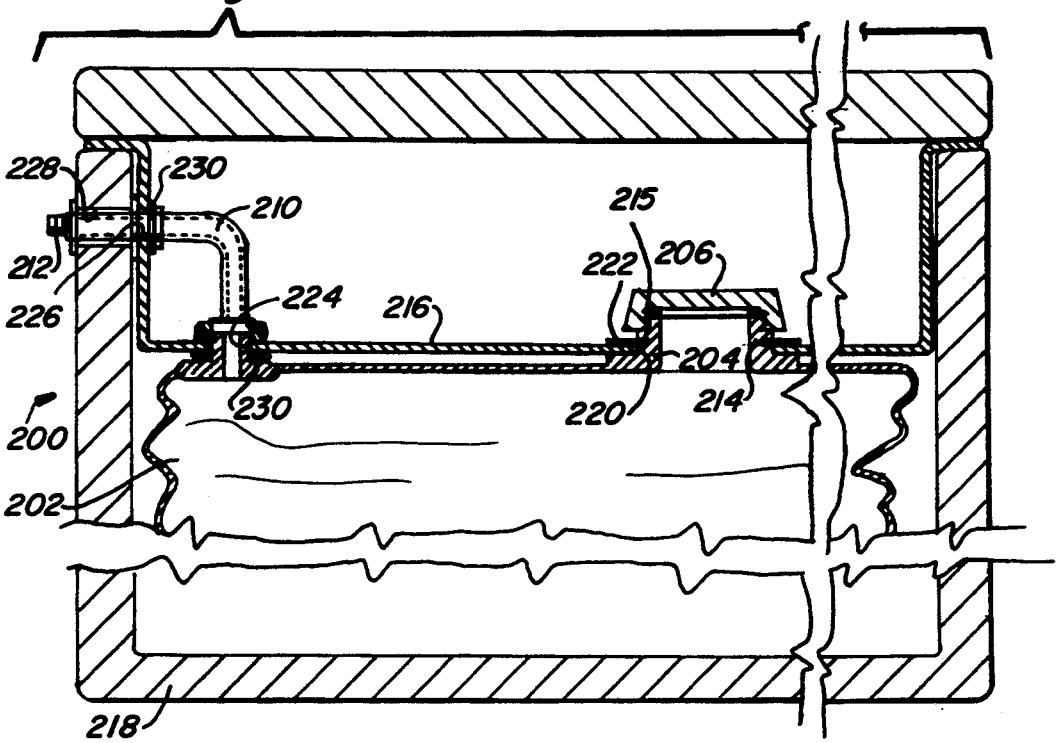

SYSTEM FOR CONFINING ARTICLES IN A CONTAINER

This is a continuation of application Ser. No. 07/870,560, filed on Apr. 17, 1992, now abandoned.

BACKGROUND OF THE INVENTION

1. Field of the Invention

The present invention relates generally to containers in which articles are randomly and loosely retained and more specifically to a system for conveniently confining the articles within such a container so that they are not jostled when the container is transported. The system includes an enclosable bladder that is forcibly draped over the articles to retain their position and wherein the bladder is capable of retaining liquids in such a manner that the liquids can either be poured from the container or dispensed from the container under pressure.

2. Description of the Prior Art

Containers such as insulated coolers used to temporarily retain and transport food or other products in a relatively constant thermal environment are relatively old in the art. With improvements in insulation, the containers have been improved through the years but typically include an open-topped body having side walls and a bottom wall made of a thermal insulating material and a removable or pivotally mounted lid or top adapted to selectively close the open top of the body with the lid also being made of a thermal insulating material. Conventional latches and handles are provided to hold the lid in a closed position such that the entire container can be easily transported.

Since coolers of the type above-described do not have self-contained cooling systems, the users of such coolers frequently place ice cubes or other temporary refrigerant material into the cooler to retain a desired temperature for some period of time. Typically, the space within the cooler is not completely filled with the articles being retained therein, and accordingly, when the container is transported, the articles themselves may be jostled or displaced. In addition, the articles are exposed directly to the coolant material which in the case of free ice will melt over a period of time thereby leaving the articles directly exposed to the resultant water.

It is therefore desirable that coolers of the aforenoted type include means for separating the coolant medium from the articles being retained in the cooler and, further, for confining the articles so that they are not unnecessarily displaced during transportation.

It is to satisfy the above needs that the present invention has been developed.

SUMMARY OF THE INVENTION

The system of the present invention utilizes the concept of incorporating a flexible membrane into the cooler which can be forcibly draped over the articles in the container to retain the articles in a fixed position. The invention is disclosed in several embodiments wherein the flexible membrane is in fact an enclosed bladder in which liquid food products or the like can be stored. The bladder is adapted to cooperate with pour spouts or pressure operated dispensers so that the liquid food product can be easily removed from the bladder.

The system may be pressure activated or vacuum activated to forcibly drape the membrane over the articles. In one embodiment, means are provided for inflating the bladder so that the bladder expands and drapes over the top of the articles in the cooler in a conforming manner and thereby defines a space within the bladder in which liquid food products can be retained under pressure for dispensing through an appropriate dispenser.

In a second embodiment of the invention, a low pressure or vacuum can be drawn around the bladder, causing the bladder to be expanded and drape formed over the articles in the container.

As will be appreciated from the detailed description of the invention hereafter, the system can be permanently incorporated into the lid of the container or can be retrofitted to existing containers with minimal modification to the containers.

Other aspects, features and details of the present invention can be more completely understood by reference to the following detailed description of the preferred embodiments, taken in conjunction with the drawings, and from the appended claims.

BRIEF DESCRIPTION OF THE DRAWINGS

FIG. 8 is an exploded isometric view of a first embodiment of a retrofit system of the present invention incorporated into a container.

FIG. 9 is an enlarged fragmentary vertical section taken through the container of FIG. 8.

DESCRIPTION OF THE PREFERRED EMBODIMENTS

Figure 1:
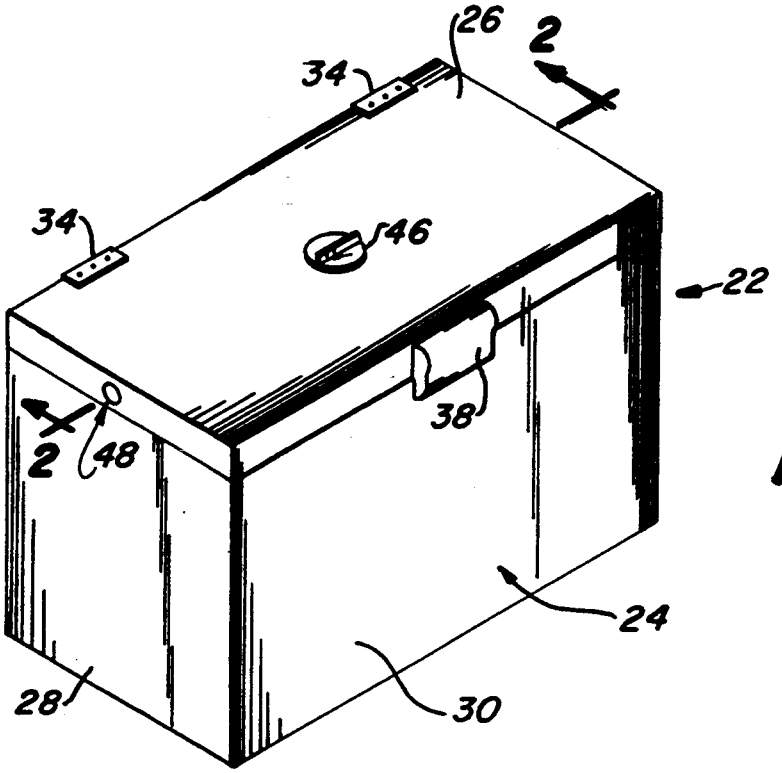
FIG. 1 is an isometric view of a container incorporating a pressure system embodiment of the present invention.
Figure 2:
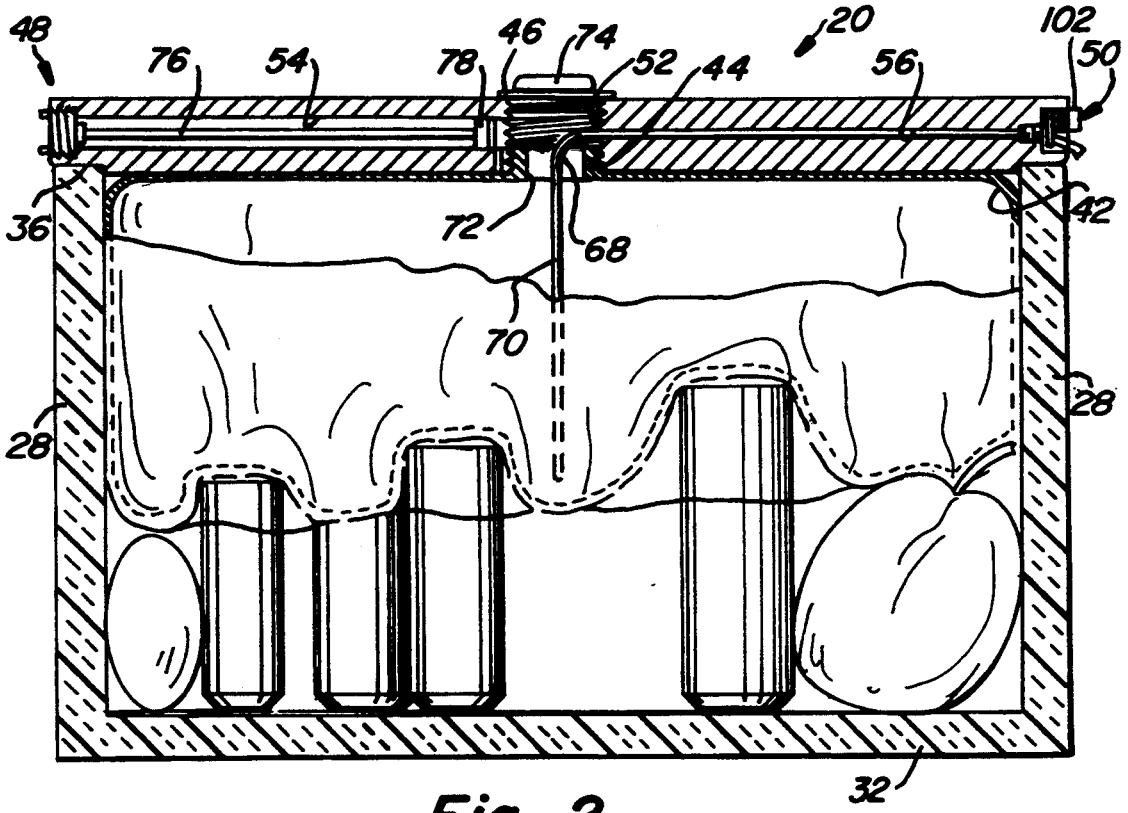
FIG. 2 is an enlarged section taken along line 2—2 of FIG. 1.

The first embodiment of the system of the present invention, which will be referred to hereafter as the pressure system 20, is illustrated in FIGS. 1 through 4. The pressure system is shown incorporated into an insulated container or cooler 22 having an open topped body 24 and a lid or top 26 hingedly connected to the body for pivotal movement between open and closed positions. The body 24 of the container includes a pair of opposed end walls 28, a pair of opposed side walls 30 and a bottom wall 32, with each wall being made of a thermal insulating material and being adjoined along perpendicular edges to adjacent wall panels in an hermetically sealed manner.

The lid 26 of the container is of rectangular configuration and also made of the same thermally insulating material as are the wall panels of the main body. The lid is pivotally connected to the top edge of one side wall 30 by a pair of spaced hinges 34 in a conventional manner. The outer perimeter of the lid along its lower surface is provided with a peripheral groove 36 adapted to mate with and receive the top edges of the side and end walls 30 and 28, respectively, when the lid is in a closed position. A conventional latch handle 38 is connected to the lid along the edge opposite that from the hinges 34 and is adapted to cooperate with a mating catch 40 (FIG. 3) so that the lid can be positively secured to the body when in a closed condition.

Figure 3:
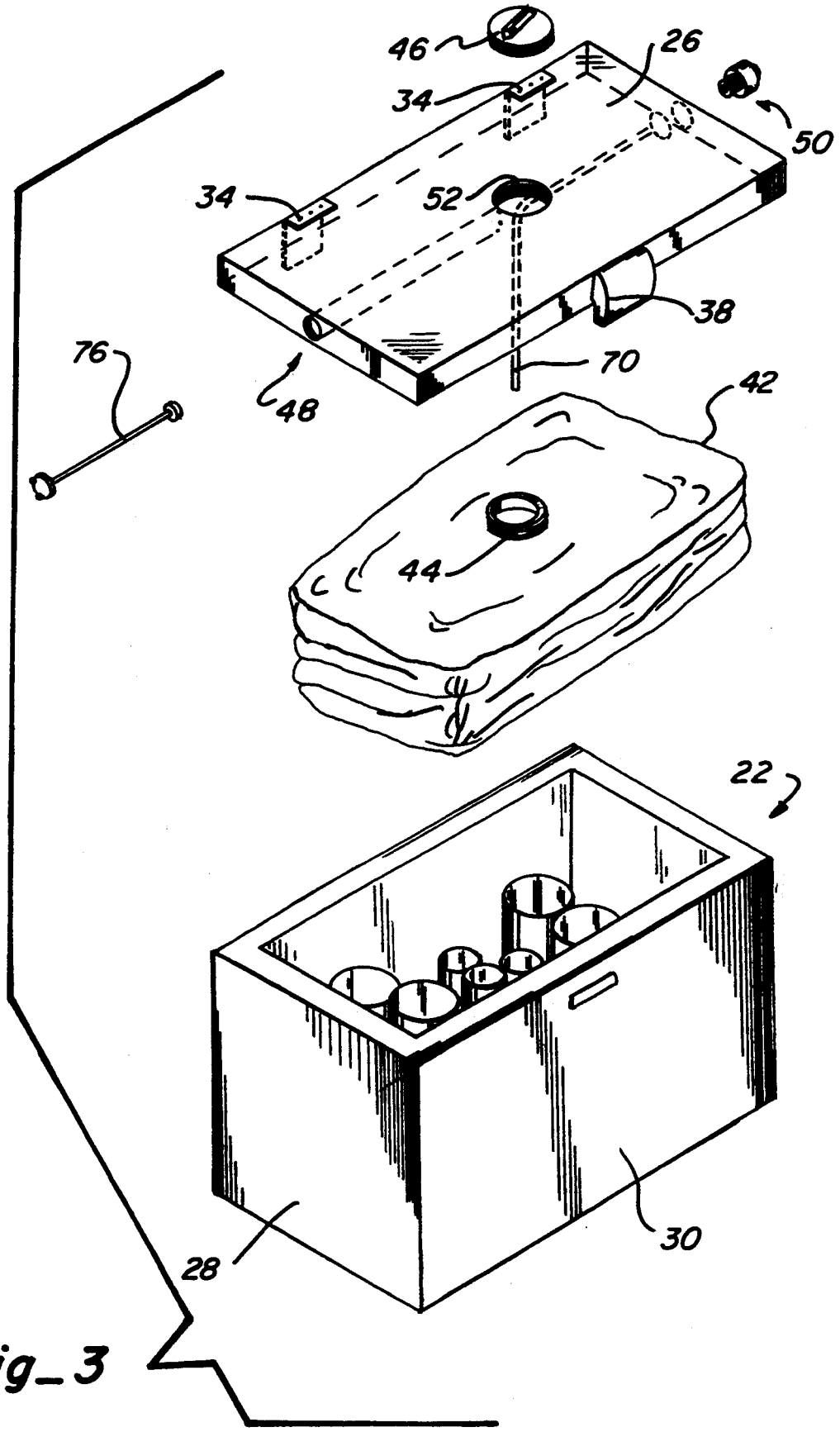
FIG. 3 is an exploded isometric view of the container of FIG. 1.

The pressure system 20 for confining articles in the container is probably seen best in FIG. 3 to include an inflatable bladder 42 having an externally threaded cylindrical neck 44 disposed in the top thereof, a threaded closure cap 46 for the neck, a manually operable pneumatic pump 48 for inflating the bladder, and a liquid dispensing system 50 through which liquids contained in the bladder can be dispensed from the container 22 under pressure.

The lid 26 of the container includes a centrally located cylindrical passage 52 therethrough which is internally threaded. Diametrically opposed longitudinal passages 54 and 56 communicate with the central passage 52 and extend longitudinally of the lid so as to open through opposing ends 58 and 60, respectively, of the lid. Longitudinal passage 54 is of slightly larger diameter than the longitudinal passage 56 and has an enlarged internally threaded bore 62 in the associated end 58 of the lid. The smaller passage 56 includes a relatively large bore 64 in the associated end 60 of the lid with a smaller threaded bore 66 in axial alignment with the relatively large bore 64 and wherein the diameter of the threaded bore 66 is larger than the passage 56 with which it is associated. The smaller longitudinal passage 56 has an elongated flexible tube 68 positively positioned and retained therein in a conventional manner defining a depending leg 70 which hangs downwardly from the underside of the lid.

The enclosed bladder 42 is made of a flexible air-impermeable material which may or may not be elastic in nature. A rubber material such as neoprene has been found to be suitable. The threaded cylindrical neck 44 is hermetically sealed in an opening 72 provided in the top of the bladder. The externally threaded neck provides communication to the interior of the bladder for purposes which will be described later. The threaded neck 44 on the bladder is adapted to be threadedly received in the lower end of the central passage 52 through the lid 26 so that the bladder is suspended from the underside of the lid. The depending leg 70 of the flexible tube 68 in the lid projects into the bladder and due to its flexible nature is deformable in cooperation with the bladder itself.

The closure cap 46 is also cylindrical in nature and is externally threaded so as to be threadably received in the upper end of the central passage 52 through the lid 26 whereby the passage can be selectively and sealingly closed by the cap. The cap includes a diametric bar 74 on its upper surface to facilitate its manipulation.

Figure 4:
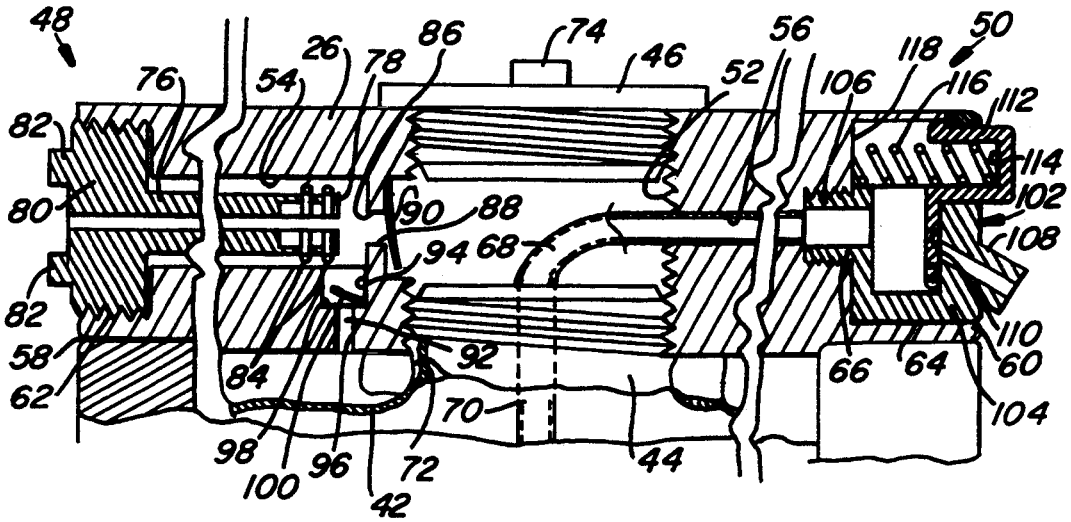
FIG. 4 is an enlarged fragmentary section taken through an upper portion of the container of FIG. 1 illustrating the interrelationship between the system of the present invention and the lid of the container.

The larger longitudinal passage 54 forms a part of the manually operable pump 48 which can be seen best in FIGS. 3 and 4 to further include an elongated hollow piston rod 76 having a piston 78 formed at one end and an enlarged gripping head 80 at the opposite end. The gripping head 80 is externally threaded so as to be threadably receivable in the internally threaded bore 62 of the passage and also includes a pair of diametrically opposed and protruding gripping pins 82 to facilitate manipulation of the pump. The piston 78 consists of a slightly enlarged cylindrical tip at the inner end of the piston rod with a pair of rubber O-rings 84 disposed concentrically therearound. The O-rings are adapted to hermetically and slidably engage the internal wall of the passage 54 as the piston rod 76 is reciprocally moved within the passage.

Near the inner end of the passage 54 where it opens into the central passage 52 through the lid 26, a radially inwardly directed peripheral rib 86 is provided which extends transversely of the passage and defines a relatively small opening 88 therethrough. A one-way valve 90 is disposed across the opening 88 which permits the inflow of air from the longitudinal passage 54 into the central passage 52 but prohibits outflow. The valve 90 in the disclosed embodiment is a flap valve made of a flexible rubber-like material.

A relatively small passage 92 extends from the longitudinal passage 54 to the undersurface of the lid 26 with the passage 92 having a relatively large upper segment 94 and a smaller lower segment 96. Across a shoulder 98 defined at the lower end of the upper segment 94, a one-way valve 100 is positioned across the lower segment 96 so as to permit the flow of air from beneath the lid to the longitudinal passage 54 but prohibit flow in the reverse direction. Again, the one-way valve 100 is disclosed in the form of a flap valve made of a flexible rubber-like material. As will be explained later with a description of the operation of the pump 48, the small passage 92 allows the pump to simultaneously draw air out of the container 22 from around the bladder 42 and transfer the air into the bladder.

The longitudinal passage 56 on the opposite side of the lid 26 from the pump 48 has a pressure dispensing spout 102 positioned in the large bore 64 formed in the end of the lid. The dispensing spout has a relatively large hollow main body 104 with a reduced diameter hollow neck 106 protruding rearwardly therefrom. The neck 106 is externally threaded so as to be threadably received in the threaded bore 66 in the passage whereby the hollow interior of the main body is always in communication with the interior of the bladder via the flexible tube 68. A rigid conduit 108 projects integrally and obliquely from the exposed face of the dispensing spout 102 and communicates with the hollow interior of the main body 104. The opening through the rigid conduit 108 into the hollow interior of the main body is selectively closable by a leg 110 on a depressible button 112 that is slidably disposed in the main body. The button has a hollow cavity 114 in a rear facing surface thereof which seats a compression spring 116. The spring abuts against an internal surface 118 of the lid 26 and thereby biases the button 112 outwardly into a closed position. It will be readily appreciated by reference to FIG. 4 that depression of the button establishes communication between the hollow interior of the main body 104 and the ambient environment through the rigid conduit 108. Depression of the button also therefore establishes communication between the interior of the bladder 42 and the ambient environment. Release of the button, however, causes the leg 110 thereon to seal the opening through the oblique rigid conduit 108 so as to seal off the communication between the ambient environment and the bladder.

In operation of the pressure system 20 of the present invention, the articles A to be transported in the container 22 are placed in the container before the lid 26 is closed whereupon closure of the lid and latching it in place defines an enclosed chamber within the container wherein the articles are supported on the bottom wall 32 of the container and the flexible bladder 42 overlies the articles. Selective operation of the pump 48 permits air to be directed into the bladder to inflate the bladder, thereby causing it to expand, drape across and form fit to the upper surfaces of the articles A in the container. In other words, the bladder is forced pneumatically onto the articles, and with an appropriate amount of pressure in the bladder, the articles will be confined in position within the container.

The pump 48 can be operated in either of two modes with one mode transferring air from the chamber around the bladder 42 into the interior of the bladder and the second mode transferring air from the exterior of the container 22 to the interior of the bladder. In the first mode of operation, the head 80 of the pump is first threadably released from the lid 26 of the container, and an operator's thumb is placed over the hole through the head which in turn seals the hollow passageway through the piston rod 76 so that no air is allowed to move therethrough. By reciprocating the piston 78 within the passage 54, air is withdrawn from the space in the container that surrounds the bladder 42 and transferred into the interior of the bladder. More specifically, as the piston rod is withdrawn or moved axially in an outward direction, air is drawn through the one-way valve 100 into the passage 54 and in the space that was previously occupied by the piston and piston rod. An opposite or inward movement of the piston rod causes the air that was drawn into the passage to be forced through the other one-way valve 90 into the central vertical passage 52 through the lid of the container and subsequently into the bladder itself. It will be appreciated that each of the valves 90 and 100 is a one-way valve and is mutually exclusive so that as the piston is withdrawn, air is drawn out of the container into the passage 54 but air is not removed from the bladder, whereas, upon a reverse stroke of the piston, air is forced into the bladder but is not forced back into the space surrounding the bladder. It will also be appreciated that, upon continuous reciprocation of the pump, air is withdrawn from the space surrounding the bladder and transferred into the bladder so that a differential pressure is immediately established between the interior of the bladder and the exterior of the bladder causing the bladder to expand and drape form onto the articles A within the container.

In the alternative mode of operation of the pump 48, the operator's thumb is removed from its overlying relationship with the hollow passage through the piston rod 76 so that, as the piston rod is withdrawn, air from the ambient environment is drawn into the passage 54, and upon a reciprocal or compressing stroke, the operator's thumb can again be positioned over the opening through the piston rod so that the air in the passage 54 is forced through the valve 90 and into the interior of the bladder 42. This latter mode of operation would probably only be necessary on the last few strokes of inflating the bladder when it is easier to draw additional air from outside the container than from inside the container where there is very little if any air remaining.

Prior to inflating the bladder 42 with compressed air, the closure cap 46 can be temporarily removed so that liquid food product or a cooling medium such as ice can be placed in the bladder through the central passage 52 in the lid. If the bladder is filled with a liquid food product, once the bladder has been pressurized in the manner hereinbefore described, the liquid can be dispensed under pressure through the dispensing spout 102 merely by depressing the button 112 on the dispensing spout which thereby places the passage through the oblique rigid conduit 108 in fluid communication with the interior of the bladder. Since the bladder is under higher pressure than the ambient environment, any liquid in the bladder will be forcefully driven from the bladder through the flexible tube 68 and subsequently through the dispensing spout.

It will be appreciated that the pressure system embodiment of the present invention is not only useful in confining articles to a fixed position within a container but in also providing means by which liquid food products or the like can be dispensed from the container under pressure. Further, it will be appreciated that thermal cooling units used to retain the interior of the container at relatively low temperatures are isolated within the bladder and are therefore separated from the articles confined in the container. In this manner, even if the cooling medium were allowed to melt over a substantial period of time, the resulting water or the like would not commingle with the articles but would be segregated therefrom.

Figure 5:
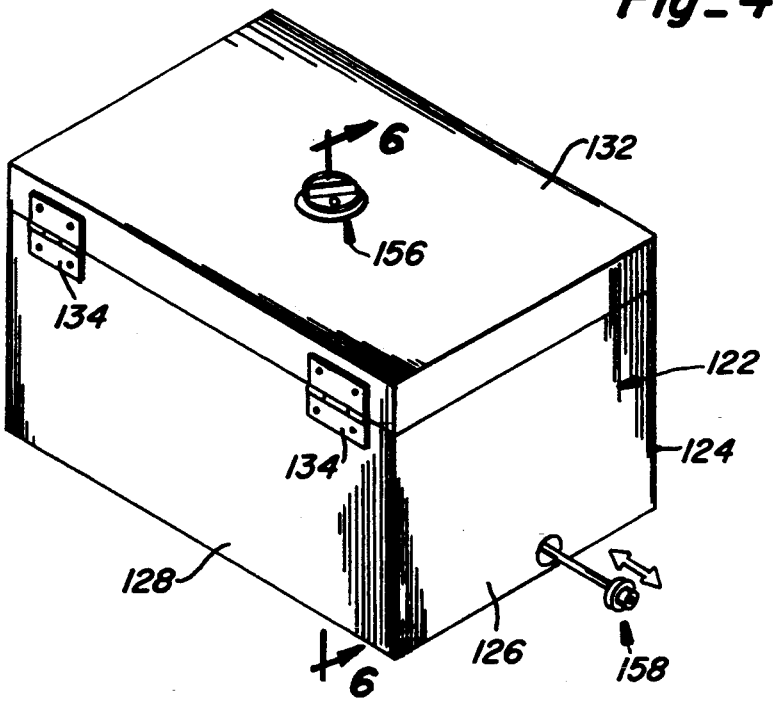
FIG. 5 is an isometric view of a container incorporating a vacuum system embodiment of the present invention.
Figure 6:
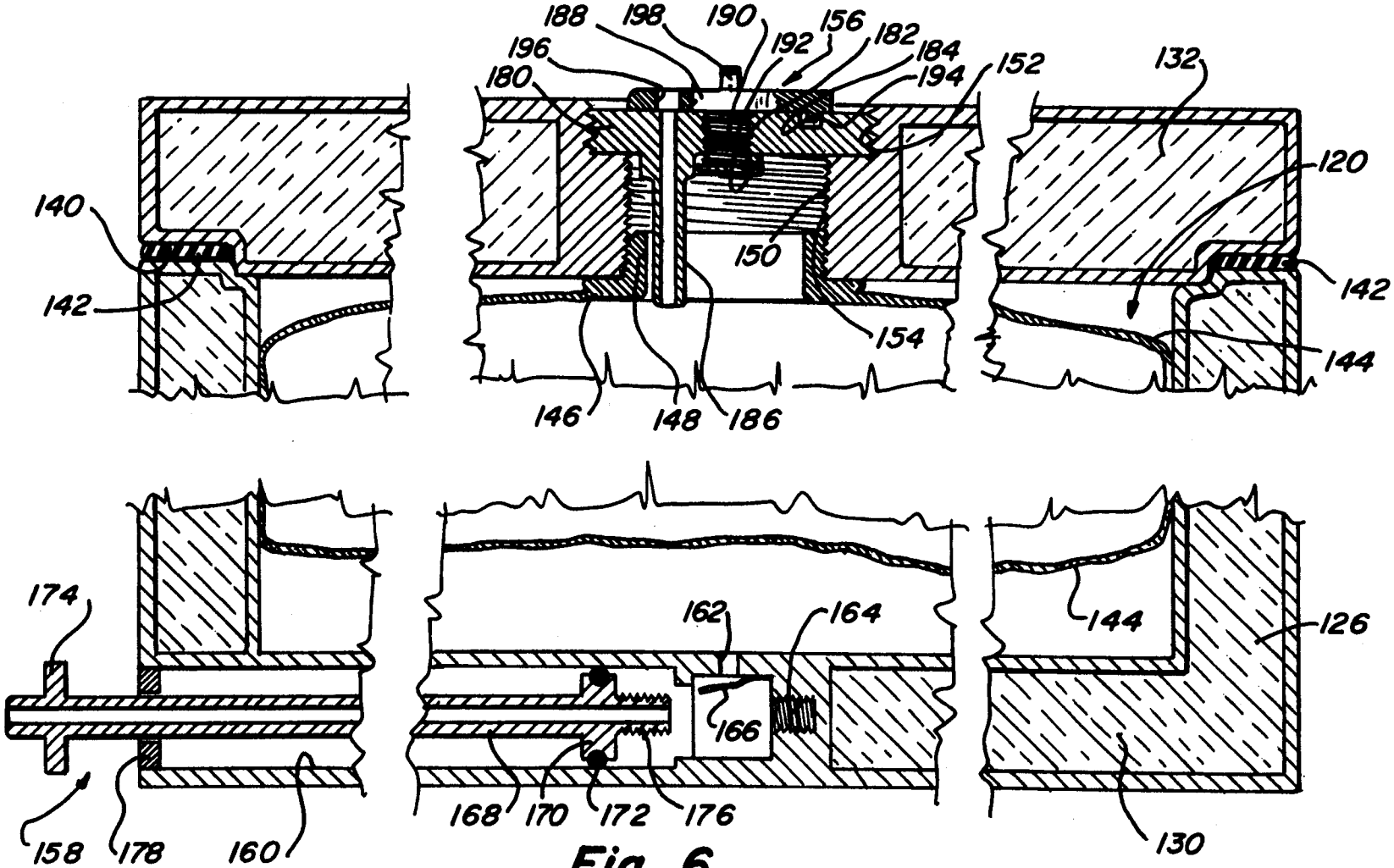
FIG. 6 is an enlarged fragmentary section taken along line 6—6 of FIG. 5.
Figure 7:
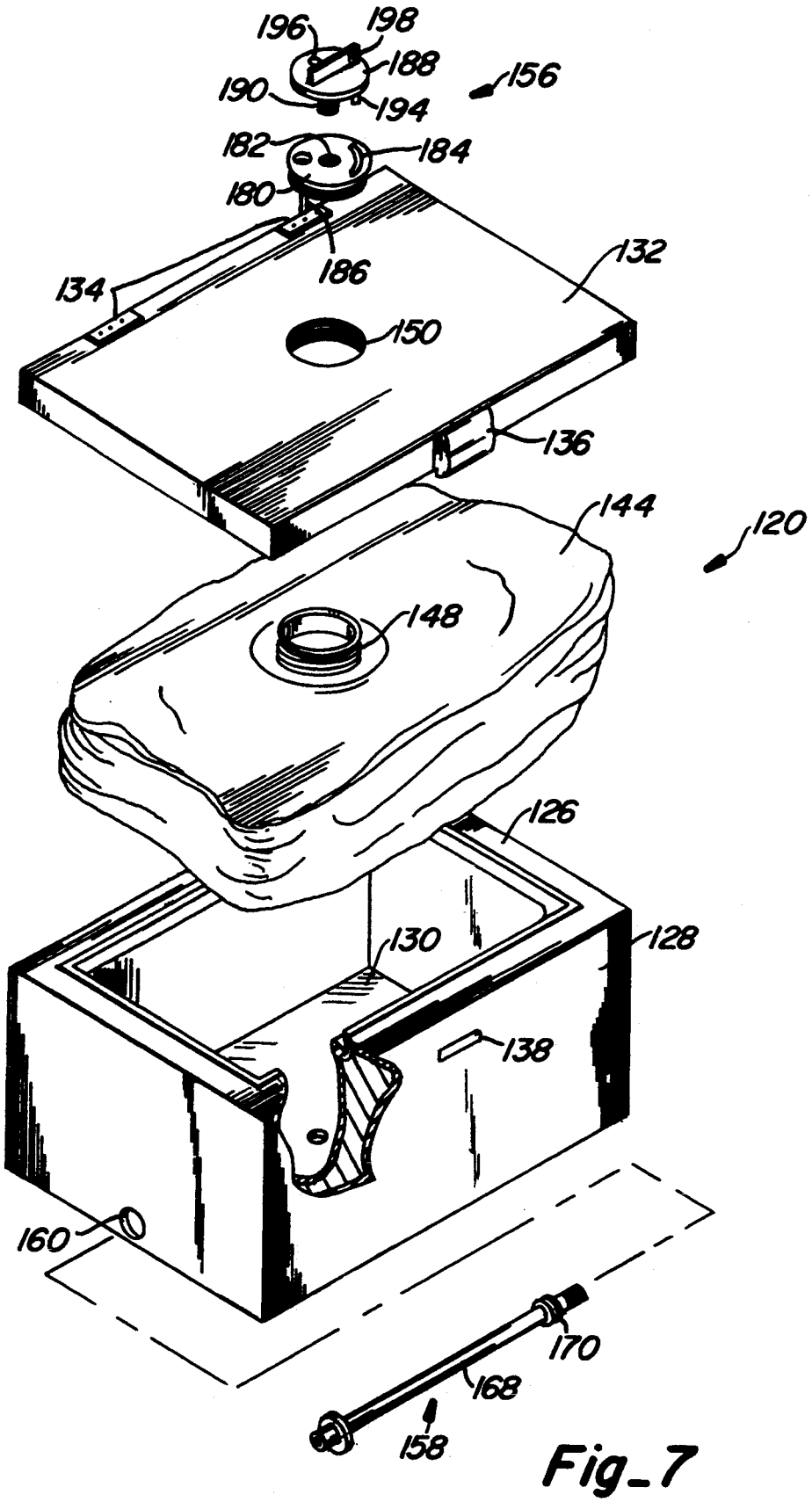
FIG. 7 is an exploded isometric view of the container shown in FIG. 5.

The second embodiment of the present invention, which will be referred to hereinafter as the vacuum system is illustrated in FIGS. 5 through 7. The vacuum system is also mounted in a container 122 having a main body 124 with a pair of opposed end walls 126, a pair of opposed side walls 128 and a bottom wall 130, each of which are sealingly connected in mutually perpendicular relationship to define the open-topped body 124 of the container. A lid 132 is pivotally connected to the body 124 by a pair of spaced hinges 134 interconnecting a back edge of the lid with a side wall 128. A latch 136 is connected to the front edge of the lid and cooperates with a catch 138 to selectively secure the lid in a closed and sealed relationship with the open top of the body. A recess 140 (FIG. 6) is provided along the peripheral lower edge of the lid 132 to receive an hermetic sealing element 142 which might be neoprene rubber or the like so that when the lid is latched in a closed relationship with the body 124 of the container, an hermetically sealed compartment is defined within the interior of the container. The walls of the body 124 and the lid 132 are all made of conventional thermally insulating material.

The vacuum system 120 includes a flexible air impermeable membrane 144 forming a bladder and having an opening 146 in its top in which is sealingly received a cylindrical threaded neck 148. The neck is adapted to be threadably received in a central internally threaded passage 150 through the lid 132. The central passage through the lid has a relatively large diameter portion 152 adjacent to the top of the lid and a smaller diameter portion 154 adjacent to the bottom of the lid with the smaller diameter portion receiving the neck 148 of the bladder. The larger diameter portion of the passage threadably receives a closure member 156 to be described in more detail later.

The vacuum system 120 further includes a vacuum pump 158 formed in the bottom wall 130 of the container where a cylindrical longitudinal passage 160 extends inwardly from one end of the container to approximately the longitudinal center of the bottom wall. At the longitudinal center, a vertical passage 162 connects the interior of the container with the longitudinal passage 160. At the innermost end of the longitudinal passage, a reduced diameter threaded bore is 164 provided for a purpose to be described later. A one-way flap type valve 166 is positioned in the longitudinal passage 160 in alignment with the vertical passage 162 to permit only one-way flow of air out of the container.

The pump 158 further includes a piston rod 168 and a piston 170 near the inner end of the rod with the piston constituting an enlarged diameter portion of the rod and wherein a rubber O-ring 172 extends around its perimeter. The rubber O-ring is adapted to hermetically slide along the walls of the longitudinal passage 160. The piston rod itself is hollow and opens through both ends with an outer end of the piston rod having a disk-like gripping element 174 to facilitate operation of the pump. The innermost end 176 of the piston rod 168 is externally threaded and adapted to be threadably received in the threaded bore 164 at the inner end of the longitudinal passage. Threaded engagement between the piston rod and the bore 164 allows the piston rod to be retained within the longitudinal passage, but threadably releasing the piston rod from the bore allows the piston rod to be reciprocally moved in the longitudinal passage. A ring insert 178 is provided in the end of the bottom wall 130 of the container adjacent to the opening of the longitudinal passage 160 with the ring serving as a guide for reciprocating movement of the piston rod 168.

The closure member 156 has three component parts with the main body 180 of the member comprising an externally threaded disk adapted to be threadably received within the upper larger diameter portion 152 of the central passage 150 through the lid. The main disk 180 has a central opening 182 therethrough and an arcuate slot 184 formed in its top surface at a radially spaced location from the central opening 182. Diametrically opposed from the arcuate slot 184 is a pour spout 186 which in FIGS. 6 and 7 is directed downwardly but forms a substantially cylindrical and perpendicular extension away from the underside of the main disk. The pour spout 186 has a cylindrical axial passage therethrough. A control disk 188 component of the closure member 156 is pivotally and contiguously connected to the main disk 180 along its top surface. The control disk has a cylindrical main body and a depending shaft or pin 190 that is centrally located and adapted to extend through the central opening 182 in the main disk. The shaft 190 is externally threaded and receives a nut-type fastener 192 on its lower end to secure the control disk in pivotal relationship to the main disk. The control disk has a depending peg 194 that is radially displaced from the central shaft and is adapted to extend into and be confined within the arcuate slot 184 in the main disk. Slightly offset from a diametric relation to the peg 194 is an opening 196 through the control disk which is adapted to be selectively aligned and misaligned with the pour spout 186 depending upon the angular relationship of the control disk with the main disk. In other words, from one extreme of pivotal movement of the control disk to the other, the opening 196 in the control disk can be aligned with or misaligned with the passage through the pour spout 186 for purposes to be described hereinafter.

In operation of the vacuum system 120 of the present invention, articles to be transported in the container, which have not been shown, are positioned within the container on the bottom wall 130, and the lid 132 of the container is subsequently closed and latched in place to establish an hermetically sealed internal compartment in the container. It will be appreciated that the flexible bladder 144 will overlie the articles placed on the bottom wall of the container so that, when a vacuum is drawn in the container around the bladder by the vacuum pump, the bladder is allowed to expand and drape form itself over the articles to hold them in place. The vacuum is drawn by threadably releasing the piston rod of the pump 158 from the threaded bore 164 so that the piston rod 168 can be reciprocally moved axially within the longitudinal passage 160. By placing one's thumb over the outlet from the piston rod and withdrawing the piston rod in an outward stroke, air can be drawn from the interior of the container through the one-way valve 166 into the longitudinal passage 160 between the piston 170 and the inner end of the passage. A subsequent inward stroke of the piston rod, after the operator's thumb is removed from its overlying relationship with the outlet from the piston rod, will allow the air that has been trapped in the longitudinal passage 160 to pass outwardly into the ambient environment through the passage in the piston rod. The air will not be forced back into the interior of the container on the inward stroke due to the flap valve 166 which permits only air passage out of the container. Continuous reciprocating strokes of the afore-described nature will withdraw air from the interior of the chamber until a desired low pressure has been established around the bladder.

As will be appreciated, the bladder 144 will thereby define a segregated space within the interior of the container wherein a coolant medium such as ice can be placed. Liquid food products can also be kept in the bladder which can be poured from the bladder through the pour spout 186.

It is probably desirable when drawing the vacuum within the container 122 to leave the opening 196 through the control disk 188 of the closure member 156 in alignment with the passage through the pour spout 186 so that atmospheric air pressure is permitted within the bladder 144. When the bladder is fully expanded, however, and it is desired to transport the container, the control disk is pivoted so that the opening therethrough is misaligned with the passage through the pour spout so that any liquid in the bladder will not be spilled during transport.

If the bladder 144 contains liquid food product, and it is desired to pour the liquid from the bladder, the closure member 156 can be inverted by gripping a diametric tab 198 on the upper surface of the control disk and rotating the disk in a counterclockwise direction which will cause the main disk 180 to become threadably disengaged from the lid. Inverting the closure member so that the control disk is beneath the main disk places the pour spout so that it is upwardly directed, and by gripping the pour spout, the main disk can again be threadably seated in the main passage 150 through the lid. By tipping the container, the liquid in the bladder can be poured through the pour spout in a controlled manner.

The system of the present invention is also adapted to be retrofitted into existing containers or coolers either by incorporating the system into the lid of the cooler or by incorporating the system into a tray which is commonly found in camping-type coolers. The tray is typically supported along the top edge of the main body of the cooler and depends a short distance thereinto.

An arrangement 200 of a retrofit system is illustrated in FIGS. 8 and 9 and includes an inflatable bladder 202 made of a flexible air impermeable material with the bladder having an opening in the top thereof in which is sealingly seated a neck 204 having external threads on its uppermost end. An internally threaded closure cap 206 is hermetically and removably received on the neck 204. A second opening is provided in the bladder 202 that receives an L-shaped but slightly flexible valve stem 210. The valve stem is sealed at one end in the wall of the bladder and has a pneumatic two-way valve 212 on the opposite end of the type conventionally found on pneumatic tires and the like.

The neck 204 in the top of the bladder 202 has a head 214 where the external threads are provided and beneath the head an annular groove 215 is formed in the neck. To connect the bladder to a tray 216 in a container 218, an opening 220 is drilled through the bottom of the tray of a size adapted to receive the head 214 and the neck 204. A snap ring 222 can be positioned beneath the head 214 but above the bottom wall of the tray in the groove 215 to attach the bladder to the tray. Holes 224 and 226 are provided through the bottom and a side wall, respectively, of the tray and are adapted to receive the valve stem 210 which is long enough to protrude not only through the holes in the tray but through another aligned hole 228 provided in an end wall of the container Rubber grommets 230 seated in the holes 224 and 226 in the tray retain the valve stem in position.

As will be appreciated, with the bladder 202 attached to the tray 216, articles of food or the like can be placed in the container by lifting the tray while being careful to guide the valve stem 210 out of the hole 228 provided through the end wall of the container. After the articles have been placed in the container, the tray can again be inserted into the container by guiding the valve stem into the hole 228 in the end wall so that the valve 212 is accessible from exteriorly of the container and allowing the rim around the top of the tray to rest upon the top edges of the walls of the main body of the container. After the lid of the container has been latched in a closed position in a conventional manner, air can be injected into the bladder through the valve 212 and valve stem 210 to inflate the bladder and thereby forcefully drape form the bladder over the articles in the container to hold them in place.

Prior to inflating the bladder, however, it is possible to place a refrigerant material in the bladder such as ice cubes or the like or, alternatively, liquid food products can also be placed in the bladder through the neck 204 in the top thereof. Of course, to release the air from the bladder, the valve 212 can merely be depressed in a conventional manner. It is not necessary to relieve the air from the bladder, however, prior to removing the tray from the cooler.

Liquid or partially melted ice cubes and the like can be removed from the bladder through the opening and neck 204 in the top of the bladder merely by removing the closure cap 206 provided thereon.

Figure 10:
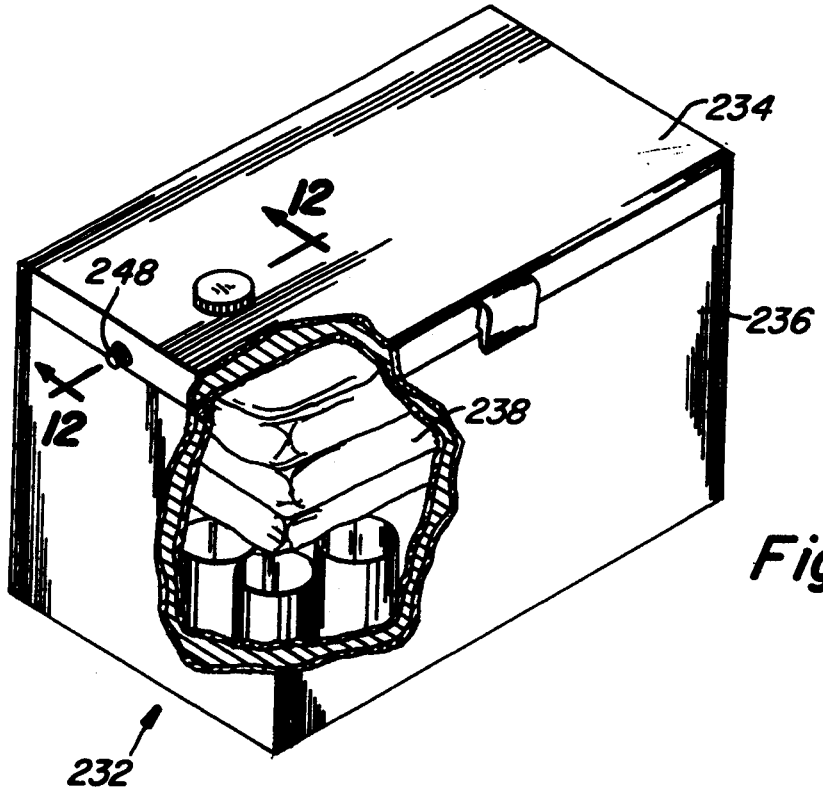
FIG. 10 is an isometric view of a container incorporating a second embodiment of the retrofit system of the present invention.
Figure 11:
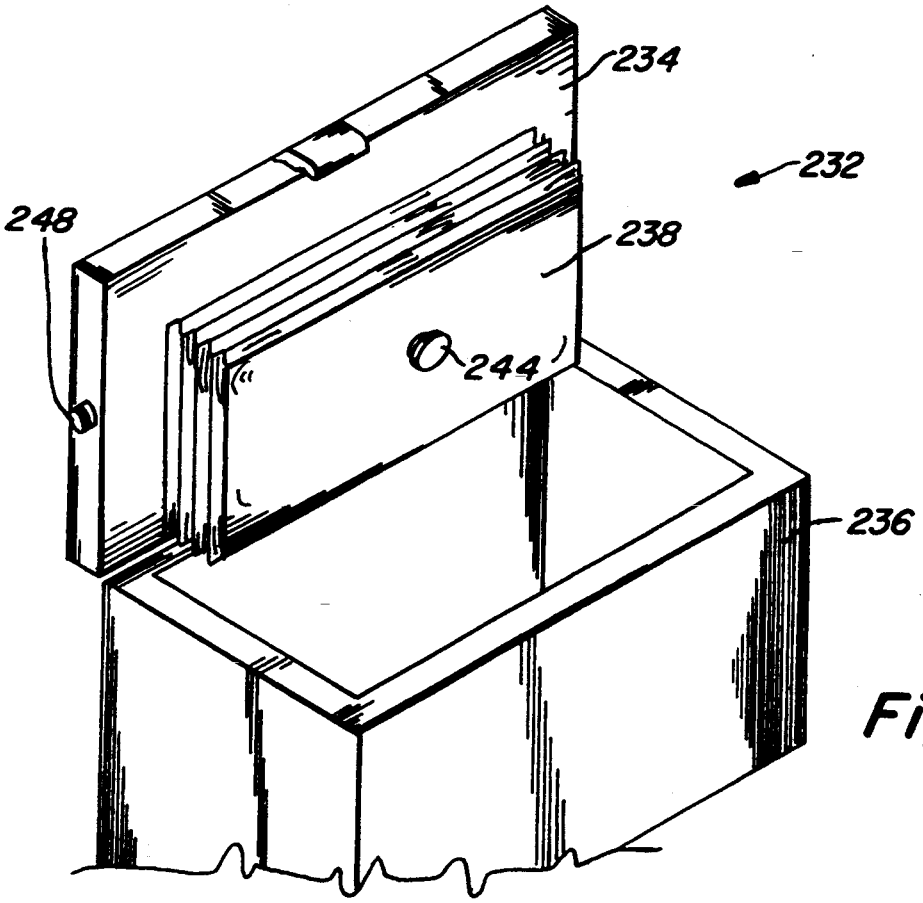
FIG. 11 is a fragmentary isometric view of the container of FIG. 10 with the lid of the container in an open position.
Figure 12:
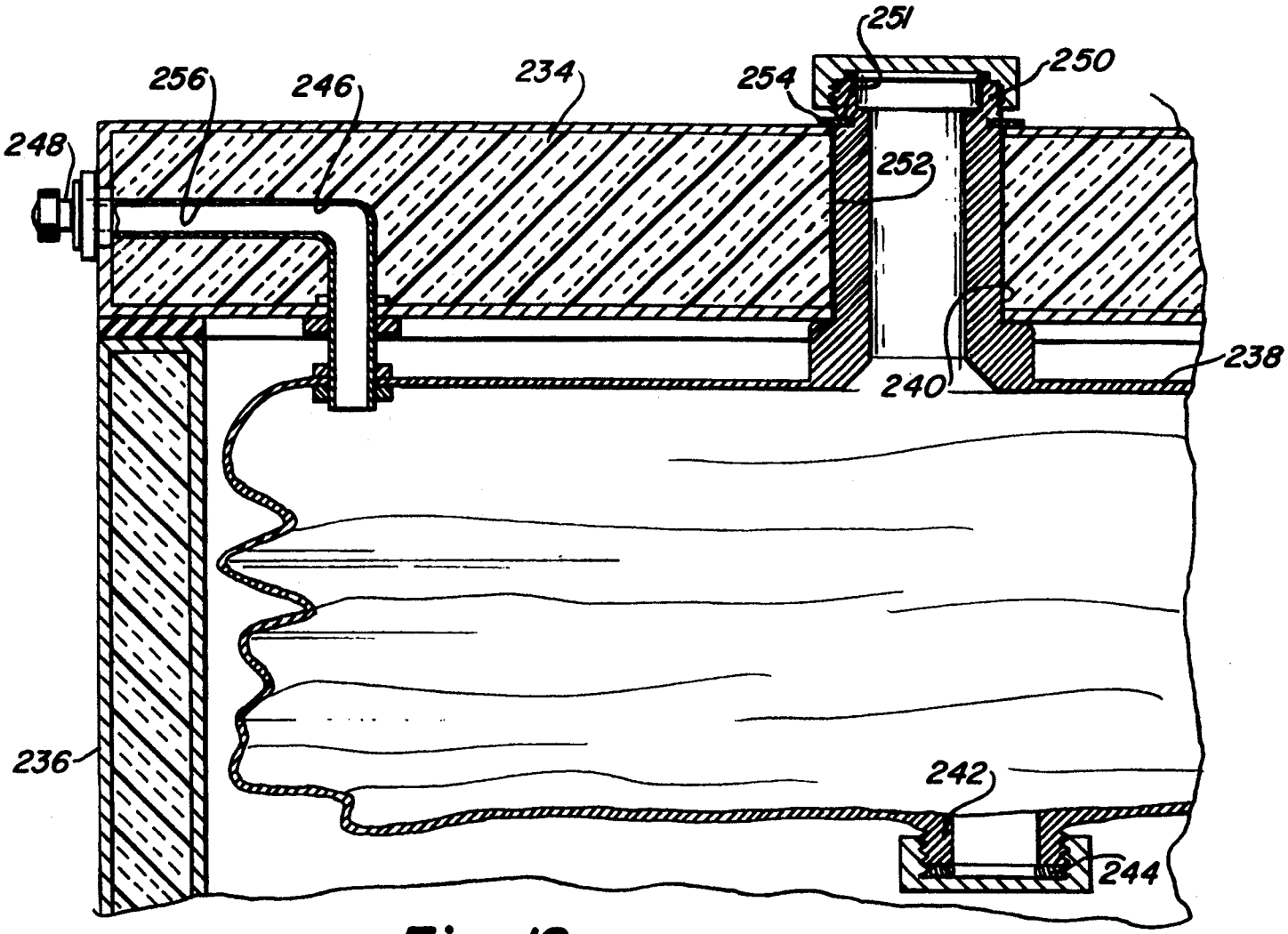
FIG. 12 is a fragmentary enlarged section taken along 12—12 of FIG. 10.

A second arrangement 232 of the retrofit system is illustrated in FIGS. 10 through 12 for incorporation into the lid 234 of a container 236 rather than a tray. In this arrangement, as with the first described arrangement of a retrofit system, the system includes an inflatable bladder 238 made of a flexible air impermeable material with the bladder having an opening in the top thereof in which is sealingly seated a neck 240 having external threads on the uppermost end thereof. A similar opening and neck 242 is provided in the bottom of the bladder for drainage purposes, and a closure cap 244 is threadably sealed on the drainage neck 242. A third opening is provided in the bladder that receives an L-shaped but slightly flexible valve stem 246. The valve stem is sealed at one end in the wall of the bladder 238 and has a pneumatic two-way valve 248 on the opposite end of the type conventionally found on pneumatic tires and the like.

The neck 240 in the top of the bladder 238 is relatively long and of a length adapted to extend through the lid 234 of the container 236. The neck has a radially enlarged head 250 where the external threads are provided and immediately beneath the head an annular groove 251 is formed in the neck. To connect the bladder to the lid of the container, an opening 252 is drilled through the lid of a size adapted to receive the head 250 and neck 240. A snap ring 254 can be positioned beneath the head 250 but above the lid to attach the bladder to the lid. An L-shaped hole 256 is also provided through the lid 234 of the container to receive the valve stem 246.

The operation of this arrangement of the retrofit system is similar to that for the first described arrangement 200 of the retrofit system except that the valve stem 246 does not have to be guided in and out of a hole in the wall of the container.

It will be appreciated from the afore-noted description of the invention that a system has been developed for not only confining articles within an enclosed container in a manner which will positively hold the articles in place but also provides means for isolating a coolant medium from other goods in the container. The system also provides a separate space within the container wherein liquid products can be confined and, in certain embodiments, in a pressurized state for convenient dispensing.

Although the present invention has been described with a certain degree of particularity, it is understood that the present disclosure has been made by way of example, and changes in detail or structure may be made without departing from the spirit of the invention, as defined in the appended claims.

We claim:

1. A container for storing an article and restraining the same against movement, said container comprising:

a body defining an open-topped chamber and having a bottom wall upon which said article is positioned, a top for selectively covering the chamber, said top including a sealable opening extending therethrough;

an expandable membrane positionable in said chamber to overlie said article, said expandable membrane having a neck sealingly attached to said sealable opening for affixing said membrane to said top and for forming a passageway through said sealable opening into said membrane, said passageway permitting liquid and solid materials to be inserted into said membrane; and an air pump for generating an air pressure differential between said membrane and said chamber beyond said membrane to cause air pressures within said membrane to be greater than air pressures within said chamber beyond said membrane, thereby to expand said membrane in a form-fit engagement about said article to confine said article and restrain said article against movement.

2. The container of claim 1 wherein said air pump is in fluid communication with said membrane for pumping air into said membrane to increase pressure levels within said membrane relative to pressure levels within said chamber beyond said membrane.

3. The container of claim 1 wherein said air pump is positioned external to said body.

4. The container of claim 3 wherein said top of said body which selectively covers said chamber comprises a tray member positionable to cover said chamber defined by said body.

5. The container of claim 4 further comprising a valve assembly having a valve member extending to the exterior of said body for interconnecting with said air pump and a valve stem extending through said tray member between said valve member and said membrane, thereby to position said pump in the fluid communication with said chamber.

6. The container of claim 2 wherein said air pump is positioned in said top of said body in fluid communication with said sealable opening.

7. The container of claim 6 wherein said air pump is in the fluid communication within said chamber both beyond said membrane and within said membrane by way of the sealable opening for reducing pressure levels within said chamber beyond said membrane relative to pressure levels within said membrane.

8. The container of claim 6 wherein said air pump includes a cylinder formed to extend longitudinally between a side of said top of said body and said sealable opening, and an elongated piston rod having a piston head at an end portion thereof, said piston rod and said piston head together capable of reciprocating movement in said cylinder to pump air into said membrane.

9. The container of claim 1 wherein said air pump is in fluid communication with said chamber beyond said membrane for reducing pressure levels within said chamber beyond said membrane relative to pressure levels within said membrane.

10. The container of claim 9 wherein said air pump includes a cylinder formed to extend longitudinally through said bottom wall of said body beneath said chamber, a vertical passageway extending between said cylinder and said chamber, and an elongated piston rod having a piston head at an end portion thereof, said piston rod and said piston head together capable of reciprocating movement in said cylinder to pump air out of said chamber.

11. The container of claim 1 wherein said liquid materials permitted to be inserted into said membrane are poured into said membrane through said passageway formed through said sealable opening.

12. The container of claim 11 wherein said passageway formed through said sealable opening is of diametrical dimensions permitting a solid, coolant medium of a desired size to be inserted into said membrane.

13. The container of claim 1 further comprising a liquid dispensing spout positioned in said top of said body to extend between said membrane and beyond said body, said liquid dispensing spout for selectively dispensing said liquid materials stored in said membrane.

14. A container for storing an article and restraining the same against movement, said container comprising: a body defining an open-topped chamber in which said article is positioned, a top for selectively covering the chamber, said top including a sealable opening extending therethrough, an expandable membrane positionable in said chamber to overlie the article, said expandable membrane having a neck sealingly attached to said sealable opening for forming a fluid path through said sealable opening into the membrane, and an air pump mounted in said top in fluid communication with said expandable membrane through said sealable opening for increasing the air pressure in said membrane thereby to expand said membrane to confine the article in the container.

* * * * *